United States Patent [19]

Benz et al.

[11] 4,339,116

[45] Jul. 13, 1982

[54] APPARATUS FOR CENTERING AND CLAMPING CIRCULAR WORKPIECES

[75] Inventors: Gottlieb Benz, Flums; Hans-Jakob Egg, Ellikon, both of Switzerland

[73] Assignee: George Fischer Limited, Switzerland

[21] Appl. No.: 195,053

[22] Filed: Oct. 8, 1980

[30] Foreign Application Priority Data

Oct. 11, 1979 [CH] Switzerland ..... 9163/79

[51] Int. Cl.[3] ..... B25B 1/20

[52] U.S. Cl. ..... 269/132; 269/130; 269/225; 269/902

[58] Field of Search ..... 254/251; 269/34, 130–132, 269/108, 134, 225, 126, 902, 32

[56] References Cited

U.S. PATENT DOCUMENTS

| | | | |
|---|---|---|---|
| 1,051,585 | 1/1913 | Hiniker | 269/225 |
| 1,269,381 | 6/1918 | Burnett | 254/251 |
| 1,289,252 | 12/1918 | Payne | 254/251 |
| 2,696,065 | 12/1954 | Harmes | 269/132 |
| 2,795,984 | 6/1957 | Sladek | 269/131 |
| 3,224,754 | 12/1965 | Graham | 269/130 |
| 3,386,726 | 6/1968 | Lorenz | 269/32 |
| 3,559,981 | 2/1971 | Abshear | 269/130 |
| 3,580,459 | 5/1971 | Gage | 269/34 |
| 3,661,378 | 5/1972 | Dodge et al. | 269/131 |

FOREIGN PATENT DOCUMENTS

| | | | |
|---|---|---|---|
| 630874 | 5/1936 | Fed. Rep. of Germany | 269/34 |

*Primary Examiner*—Robert C. Watson

*Attorney, Agent, or Firm*—Roylance, Abrams, Berdo & Farley

[57] ABSTRACT

A clamping apparatus includes jaws carried by a frame and movable toward each other to center and engage a workpiece by a lever and linkage arrangement which operates quickly. The workpiece is then firmly clamped by a rope which extends from the frame around the workpiece at least 360° and through a gripping device. The gripping device is urged toward the gripping position by a spring.

15 Claims, 3 Drawing Figures

APPARATUS FOR CENTERING AND CLAMPING CIRCULAR WORKPIECES

This invention relates to a clamping arrangement for clamping workpieces and particularly to an apparatus capable of the centrical clamping of workpieces, commonly tubular, which have a circular cross section, and which can have a diameter variable within a predetermined range.

BACKGROUND OF THE INVENTION

It is known to provide a mechanism for centering and clamping workpieces having circular cross sections, an example of which is found in Swiss Pat. No. 352,542. As shown therein, each clamping part has a surface which fits against a surface of another clamping part, one of the clamping parts being guided glidingly on a surface lying transversely to the direction of movement of the other part, and wherein the adjustment of one clamping part is accomplished by means of a spindle. When workpieces with varying diameters are to be clamped in succession, the clamping parts must be adjusted by means of the spindle, a time consuming process.

It is particularly disadvantageous in this mechanism, as well as in clamping arrangements known as pipe vises (for example German Utility Model No. 1,131,874 or British Pat. No. 775,111), that the workpiece is held peripherally only at three or four points, and that high surface pressures, occuring as a result of the relatively small line contact existing at the contact points results in considerable surface deformation of the workpieces, especially when the workpieces are pipes made of plastic.

This disadvantage can be overcome to a degree by broadening the surface contact of the clamping jaws, thereby decreasing the unit surface pressure, but as a result of this change, the range of the clamping apparatus is limited and is not capable of clamping castings and the like having only a short cylindrical part with corners and the like.

It is true that clamping arrangements for centering and clamping with mostly semi-circular clamping jaws with low surface pressures is known, these clamping jaws being adapted to the shape of the workpieces, as shown in German AS No. 2,212,055, but such devices require that the clamping jaws be shaped to adapt to the diameter of the workpiece being clamped which necessarily requires frequent adjustment when handling articles of different diameters.

It is also known to provide clamping arrangements for achieving lower specific clamping loads, such devices using tension bands partially encircling a workpiece in a cross sectional plane, examples of which are found in U.S. Pat. No. 3,661,378; British Pat. No. 860,754; and U.S. Pat. No. 1,644,755. However, a centrical clamping of round workpieces varying in diameters is not possible with these arrangements.

BRIEF DESCRIPTION OF THE INVENTION

An object of the present invention is to provide a clamping arrangement for handling workpieces of various diameters and of circular cross section which is capable of handling even workpieces with short cylindrical parts, and by which the workpieces can be clamped securely, firmly and in a precisely centered position at low surface pressure between the clamping elements and the workpiece, and with short handling times.

Briefly described, the invention includes a clamping apparatus for the centering and clamping of a workpiece having a circular cross section and a diameter within a predetermined range of diameters comprising the combination of a support frame, first and second jaws shaped to center and partially engage the workpiece, means for mounting the jaws on the frame for sliding movement toward and away from each other to permit the jaws to at least partially surround the workpiece, means coupled to the jaws for moving the jaws toward each other into engagement with the workpiece, and clamping means attached to the frame for firmly clamping the workpiece in the engaged position, the clamping means including an elongated pliable clamping element fixedly attached at one end to the frame and extendable around at least 360° of the workpiece, and means for gripping the clamping element at a point spaced from the one end.

Since, during initial centering of the workpiece, no significant pressure on the workpiece develops, jaws with narrow centering surfaces can be used without any high specific surface pressures occuring, so that quick adjustment of the jaws make possible a quick centering of the workpiece even in the case of successively gripped workpieces of different diameters. The workpiece clamping is accomplished evenly around the periphery of the workpiece by means of the pliable clamping element with low specific surface pressure. The clamping element, formed as a rope, makes possible a narrow construction of the clamping apparatus so that, as a result of its guidance in recesses of the centering jaws, any shifting transversely to the clamping direction is prevented and so that, even in the case of axial forces acting on the workpiece, secure clamping of the workpiece is guaranteed.

Further, as a result of the simple attachment of the rope and its facility for being clamped by a clamping lever, even workpieces with considerable variation in diameter can be clamped quickly so that a substantially uniform, strong, fixable clamping force is guaranteed as a result of the spring pull acting on the clamping lever.

Additionally, release of the clamping force for secondary adjustment of the clamped down pipe or fittings, is quickly possible by means of the clamping lever having a handle, the attachment and adjustment operation being simple.

In order that the manner in which the foregoing and other objects are attained in accordance with the invention can be understood in detail, a particularly advantageous embodiment thereof will be described with reference to the accompanying drawings, which form a part of this specification, and wherein.

Figure 1:
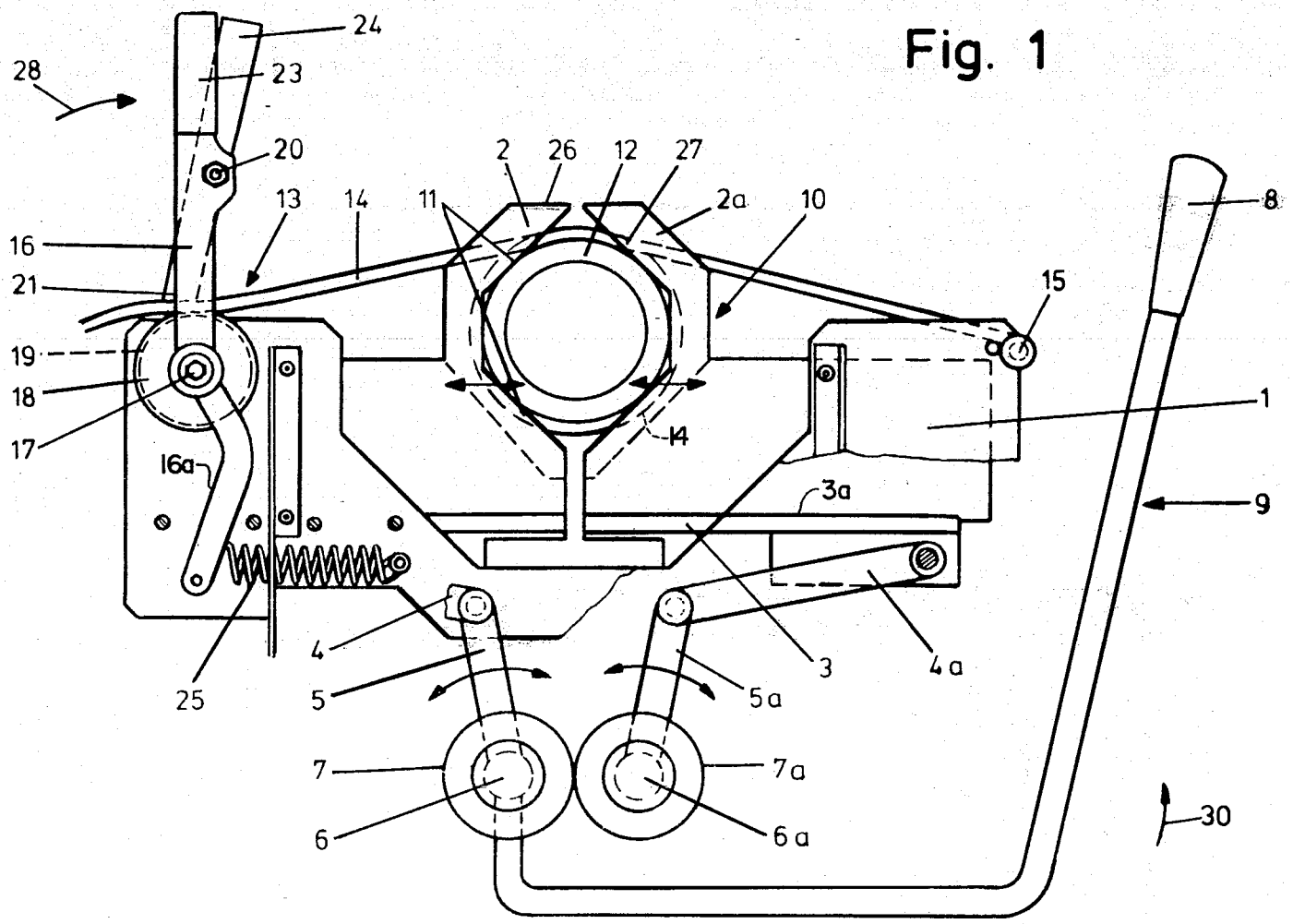
FIG. 1 is a front elevation of a clamping apparatus in accordance with the invention, partially cut-away.
Figure 2:
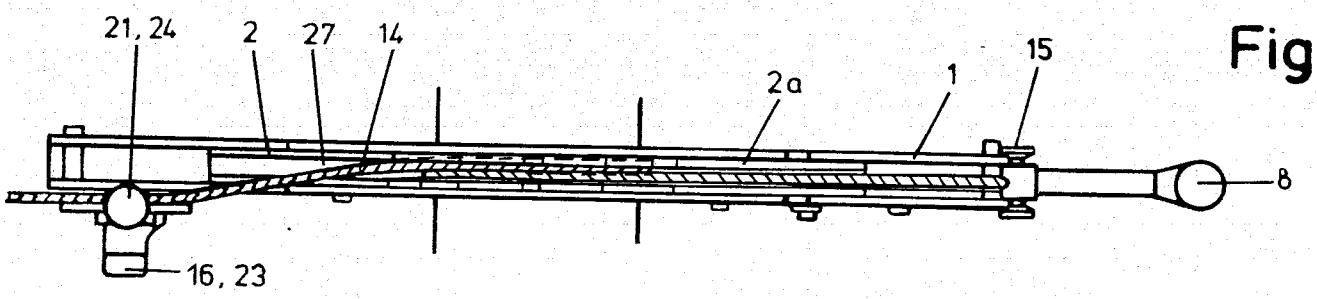
FIG. 2 is a top plan view of the apparatus of FIG. 1.

As shown in the drawings, the apparatus includes a frame structure 1 which carries two symmetrically formed jaws 2 and 2*a* which are arranged to be horizontally shiftable, the jaws being provided with guide slots 3 which ride on rails 3*a* extending inwardly from the sides of frame 1. Each of jaws 2 and 2*a* is pivotably connected to one end of a link 4, 4*a*, the other end of the link being pivotably attached to a link 5, 5*a*, respectively which is attached to, and is swingable with, a shaft 6, 6*a* rotatably mounted on the frame structure 1. Gears 7, 7*a* are attached, respectively, to shafts 6, 6*a* with the gears meshing with each other. A manually operable lever 8 is attached to shaft 6 so that angular movement of the lever causes angular movement of shaft 6. Because of the meshing of the gears, the two shafts rotate together, and in opposite directions and, through the link arrangement 4, 4*a* and 5, 5*a*, cause the jaws to move together and apart. Thus, the links, shafts, gears and manual lever 8 form a rapid attaching mechanism 9 for the simultaneous opening and closing movement of the jaws 2, 2*a* which function as a centering mechanism 10. Each of the jaws 2, 2*a* has centering surfaces 11 which form generally V-shaped openings in the jaws and which make possible the centering of workpieces 12 having a large range of diameters. In order to enlarge this range still further, it is possible to easily interchange the jaws with a set of jaws having either larger or smaller openings therein.

Figure 3:
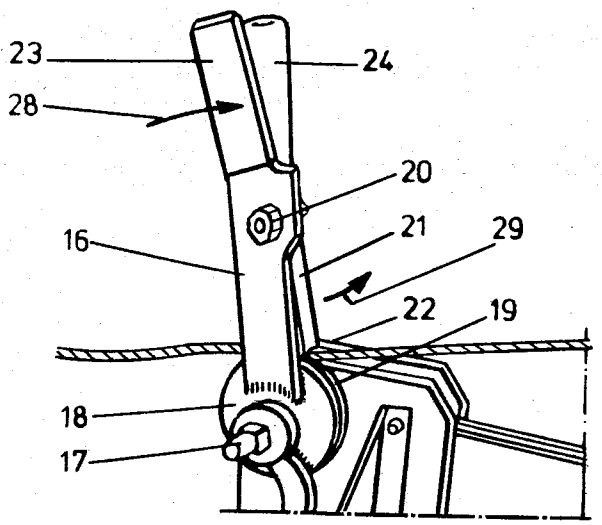
FIG. 3 is a partial perspective view of the clamping lever portion of the apparatus of FIGS. 1 and 2.

For the firm clamping of the workpieces, the apparatus is provided with clamping means 13 including a flexible or pliable clamping element 14 which is operatively associated with frame 1 and which operates independently of the centering arrangement 10. The pliable clamping element can be a band or rope 14, preferably a wire rope, one end of which is attached to a bolt 15 which is mounted at one end of frame structure 1. The rope 14 can also be made from stretched plastic polymeric or glass fibers, such as, for example, polyamide, polyethylene, terephthalate (Terylene), polyamide (Perlon, Nylon) or of an aromatic polyamide (Kevlar). On the opposite end of frame structure 1 from bolt 15, a clamping lever 16 is pivotably mounted on an axle 17, rotatably carried in the frame, which has a clamping piece 18, formed as a circular disc with a peripheral guide groove 19, in the manner of a pulley, also mounted on the axle and attached to lever 16. A second clamping lever 21 is pivotably attached to the upper portion of lever 16 by an axle or bolt 20, the lower end of lever 21 being provided with a groove 22. As best seen in FIG. 3, lever 16 is beside clamping piece 18 so that groove 22 on lever 21 lies directly above the guide groove 19 in clamping piece 18.

Guide groove 19 and groove 22, when viewed from the left or right in FIG. 1, and when lying together, form an opening having a shape corresponding to that of rope 14. Clamping lever 16 and clamping lever 21 are provided with handles 23 and 24, respectively, for their operation.

Lever 16 also includes a downwardly extending portion 16*a* which is attached to one end of a helical tension spring 25, the other end of which is pivotably connected to frame 1 in such a way that the spring tends to pull portion 16*a* to the right, thereby moving levers 16 and 21 to the left, causing groove 22 at the bottom of lever 21 to engage the rope and clamp it between the groove and clamping piece 18.

The jaws 2, 2*a* are provided, at the centers of their active centering surfaces 11, and along the upper peripheral surfaces 26, with inwardly extending recesses 27 in which the rope 4 is guided and held against shifting in axial direction with respect to the workpiece.

The sequence of events employed in clamping a workpiece 12 which is circular in cross section by means of the apparatus described herein will now be discussed. First, the two jaws 2, 2*a* are opened by moving the hand lever 8 in the direction indicated by arrow 30 far enough so that the workpiece 12 can be inserted either from above or in an axial direction so that it lies between the jaws. The rope 14 at this stage is preferrably not connected to bolt 15 and can be draped across the frame and clamping mechanism with the central portion thereof lying below and laterally of the workpiece, portions thereof thus being in recesses 27 of the jaws 2, 2*a*. The manual lever 8 is then moved in the downward direction, opposite to arrow 30, causing jaws 2, 2*a* to move together uniformly so that the active centering surfaces 11 engage the outer surfaces of workpiece 12, as a result of which the workpiece is fixed in its centered position. If the rapid adjusting arrangement 9 includes a self locking mechanism and little clearance, one can do without additional clamping down of the jaws 2, 2*a*, e.g. in the guides 3, which has not been shown. If, however, there is a clamping arrangement then this must be operated prior to the following gripping process.

Thereafter, the rope 14 is caused to cross over the top of the workpiece 12 so that the rope encircles the workpiece by at least 360°, and one end of the rope is attached to bolt 15 at one side of the frame structure. The rope is then arranged so that the upper portions thereof lie in the recesses 27 of jaws 2, 2*a*, and the other end of rope 14 is pulled until the rope snugly engages the workpiece.

The clamping lever 16 is then swiveled in the direction of arrow 28 by operation of handle 23, causing the spring 25 to be under tension. In this position of the clamping lever, the rope 14 is placed into the guide groove 19 of clamping piece 18 and is clamped therein by the lower end of clamping lever 21 by pivotable movement of levers 16 and 21 in the direction of arrow 29.

The clamping action is self-locking since a wedge effect develops between the bottom of clamping lever 21, the rope 14 and the clamping piece 18 as a result of the force of the tension spring 25. If it is necessary to readjust the workpiece in, for example, an axial direction, the clamping of the workpiece can be momentarily released by swiveling of clamping lever 16 in the direction of arrow 28.

After any desired operation is performed on the clamped pipe and it is desired to remove the workpiece from the clamping arrangement the rope is again loosened at first, as described above, and is released through the swiveling clamping lever 21, counter to the direction of arrow 29 (FIG. 3). After releasing the other end of the rope from the frame structure 1, the looping of the rope across the workpiece is released by crossing the rope back. Subsequently, the jaws 2, 2*a* can be moved apart by swinging the lever 8 upwardly, thereby releasing the clamping, whereupon the workpiece can be removed.

With the help of two clamping arrangements, formed in accordance with the invention, each of which can be moved back and forth on a carriage which can be jointly guided, it is possible to clamp and centrally locate circular workpieces with various diameters, especially plastic pipes and fittings in a simple manner, and the pipes can be moved coaxially against one another so that they can be welded together.

By distributing the clamping forces over the entire periphery of the workpiece by means of relatively thin ropes of steel wire or plastic, an axially narrow construction of the entire clamping arrangement is achieved as a result of which even fittings with short cylindrical parts can be clamped and perfectly centered.

While one advantageous embodiment has been chosen to illustrate the invention it will be understood by those skilled in the art that various changes and modifications can be made therein without departing from the scope of the invention as defined in the appended claims.

What is claimed is:

1. A clamping apparatus for centering and clamping workpieces having circular cross sections and diameters within a predetermined range of diameters along a predetermined axis, comprising a support frame;

first and second jaws shaped to center and partially engage a workpiece;

means for mounting said jaws on said frame for sliding movement toward and away from each other to permit said jaws to at least partially surround the workpiece;

means, coupled to and interconnecting said jaws, for moving said jaws simultaneously and uniformly toward each other into engagement with the workpiece to locate the workpiece at a centered position coaxially along the predetermined axis; and clamping means, attached to said frame, for firmly clamping the workpiece in said centered position, said clamping means including an elongated pliable clamping means, fixedly attached at one end to said frame, for extending in a loop of at least 360°, crossing itself and circumscribing the workpiece, and means for gripping said clamping means at a point spaced from said one end.

2. An apparatus according to claim 1 wherein said clamping means is a rope.

3. An apparatus according to claim 2 wherein said jaws include guide recesses for receiving and guiding said rope.

4. An apparatus according to either of claims 2 or 3 wherein said means for gripping is openable to release said rope.

5. An apparatus according to claim 2 wherein said means for gripping includes clamping lever means pivotally mounted on said frame for engaging and gripping said rope; and a spring for urging said clamping lever means toward its gripping position.

6. An apparatus according to claim 5 wherein the length of said rope between said one end and the location of engagement by said clamping lever means is selected in accordance with the diameter of the workpiece.

7. An apparatus according to claim 6 wherein said means for gripping further includes a rope guide mounted on said frame; and said clamping lever means includes a first lever supported for pivotal movement relative to said frame adjacent said rope guide, and a second lever pivotally mounted on said first lever with an end of said first lever being adjacent said rope guide and spaced therefrom to receive said rope.

8. An apparatus according to claim 7 wherein each of said first and second levers has a handle.

9. An apparatus according to claim 2 wherein said rope is a steel wire rope.

10. An apparatus according to claim 2 wherein said rope is formed from stretched polymeric or glass fibers.

11. An apparatus according to any of claims 1, 2, or 5–10 wherein said means for moving said jaws includes a rotatable shaft;

a manually operable arm connected to said shaft; and means for coupling said shaft to said jaws such that movement of said manually operable arm causes rapid and uniform movement of said jaws in opposite directions.

12. An apparatus according to claim 11 wherein said means for coupling includes a first gear mounted on said rotatable shaft;

a second rotatable shaft having a second gear mounted thereon, said second gear meshing with said first gear; and linkage means for interconnecting each of said shafts with one of said jaws.

13. An apparatus according to claim 12 wherein said linkage means includes first and second articulated links connected, respectively, between said shafts and said jaws.

14. An apparatus according to claim 1 wherein said means for mounting said jaws on said frame permits movement of said jaws only along a straight line path passing through the predetermined axis.

15. An apparatus according to claim 14 wherein said jaws each have V-shaped workpiece contacting surfaces.

* * * * *